US007540764B2

(12) United States Patent
Suzuki et al.

(10) Patent No.: US 7,540,764 B2
(45) Date of Patent: Jun. 2, 2009

(54) CONNECTOR

(75) Inventors: Masayuki Suzuki, Tokyo (JP); Yuki Nakano, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 12/168,047

(22) Filed: Jul. 3, 2008

(65) Prior Publication Data

US 2009/0017645 A1 Jan. 15, 2009

(30) Foreign Application Priority Data

Jul. 13, 2007 (JP) ..... 2007-184097

(51) Int. Cl.
*H01R 12/24* (2006.01)

(52) U.S. Cl. ..... 439/495; 439/260

(58) Field of Classification Search ..... 439/495, 439/492, 494, 260
See application file for complete search history.

(56) References Cited

U.S. PATENT DOCUMENTS

| | | | | |
|---|---|---|---|---|
| 6,726,497 | B2 * | 4/2004 | Nogawa et al. | 439/260 |
| 7,094,093 | B2 * | 8/2006 | Nakano et al. | 439/495 |
| 7,258,561 | B2 * | 8/2007 | Fukazawa | 439/260 |
| 2007/0010125 | A1 * | 1/2007 | Regnier | 439/495 |

FOREIGN PATENT DOCUMENTS

| | | |
|---|---|---|
| JP | 2004-071160 | 3/2004 |
| JP | 2004-206987 | 7/2004 |
| JP | 2004-221067 | 8/2004 |
| JP | 2006-147271 | 6/2006 |

* cited by examiner

*Primary Examiner*—Hien Vu
(74) *Attorney, Agent, or Firm*—Sughrue Mion, PLLC

(57) ABSTRACT

A first contact and a second contact are inserted into one and the same inserting hole of a housing so that contact portions of the first and second contacts are facing to each other. The first contacts each include the contact portion at one end and a connection portion at the other end. The second contacts each includes a first piece having the contact portion at one end and a pressure receiving portion at the other end, a second piece having connection portion at an outer end, and an elastic jointing-portion for jointing the first piece and the remaining end of the second piece. A pivoting member includes an actuating portion, pushing portions, and anchoring holes. The pushing portions are pivotally moved between the pressure receiving portions and the connection portions of the second contacts, during which pivotal movement, the axis of rotation of the pushing portions is moved with their pivotal movement to achieve their compact rotation. The second contacts are each provided on the second piece with a fixing portion in the proximity of the elastic jointing-portion. The connector constructed as above described prevents the contacts from being warped or deformed when the pivoting member is being pivotally moved, and achieves a stable electrical connection, a reduced overall height of the connector and a high density of the conductors.

2 Claims, 10 Drawing Sheets

CONNECTOR

BACKGROUND OF THE INVENTION

This invention relates to a connector for use in electric and electronic appliances such as mobile or cellular phones, notebook personal computers, digital cameras and the like, and more particularly to a connector having a structure enabling a stable electrical connection without contacts being warped or deformed when a pivoting member is being pivotally moved after a connecting object such as a flexible printed circuit board or flexible flat cable has been inserted, ensuring sufficient holding forces for the flexible printed circuit board, and achieving a reduced overall height of the connector and a high density of conductors.

A connector usually includes at least a plurality of contacts, a housing for arranging and holding the contacts, and a pivoting member mounted on the housing to be pivotally moved so that the contacts are elastically deformed so as to be in contact with a connecting object. The contacts each include a contact portion adapted to contact the connecting object, and a connection portion to be connected to a substrate. The housing is formed with a required number of inserting holes for inserting the contacts therein and with a fitting opening for inserting the connecting object thereinto. The pivoting member includes pushing portions for elastically deforming the contacts.

Patent literatures incorporated herein are Patent Literature 1 (Japanese Patent Application Opened No. 2004-71,160) disclosing a rear locking type connector, Patent Literature 2 (Japanese Patent Application Opened No. 2004-206,987) disclosing a feature of inserting two contacts into one inserting hole of a housing, and Patent Literature 3 (Japanese Patent Application Opened No. 2004-221,067) and Patent Literature 4 (Japanese Patent Application Opened No. 2006-147,271) using locking members similar in construction to contacts of the rear locking type, these being filed by the applicant of the present application.

Patent Literature 1

According to the content of the Japanese Patent Application Opened No. 2004-71,160, this invention has an object to provide a connector being capable of securely pushing a contact portions 22 of contacts 14 against flexible printed circuit board 40 or flexible flat cable by means of a slider 16 without degrading strengths of respective members and required specifications or customers demands, and achieving a superior operationality, narrower pitches of conductors and a reduced overall height. Disclosed is a connector comprising contacts 14 each having a contact portion 22, a connection portion 24, and an elastic portion 34 and a fulcrum portion 32 between the contact portion 22 and the connection portion 24, and a pressure receiving portion 20 extending from the elastic portion 34 in a position facing to the connection portion 24, and the contact portion 22,elastic portion 34, fulcrum portion 32 and connection portion 24 being arranged in the form of a crank, and a slider 16 comprising pushing portions 36 arranged continuously in the longitudinal direction and the slider 16 being pivotally mounted on a housing 12 so that the pushing portions 36 are pivotally movable between the connection portions 22 and pressure receiving portions 20 of the contacts 14.

By the way, claim 1 of the Japanese Patent Application Opened No. 2004-71,160 disclosed a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting said flexible printed circuit board or flexible flat cable, and a slider for pushing said contacts against said flexible printed circuit board or flexible flat cable, wherein said contacts each comprise an elastic portion and a fulcrum portion between the contact portion and a connection portion, and a pressure receiving portion extending from said elastic portion and located in a position facing to said connection portion, and said contact portion, said elastic portion, said fulcrum portion and said connection portion being arranged substantially in the form of a crank, and said slider is provided with pushing portions arranged continuously in its longitudinal direction and is mounted on said housing so that said pushing portions are pivotally movable between the connection portions and the pressure receiving portions of said contacts. Claim 2 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting said flexible printed circuit board or flexible flat cable, and a slider for pushing said contacts against said flexible printed circuit board or flexible flat cable, wherein two kinds of contacts are arranged to be alternately staggered, the contacts of one kind each comprising an elastic portion and a fulcrum portion between the contact portion and a connection portion, and a pressure receiving portion extending from said elastic portion in a position facing to said connection portion, and said contact portion, said elastic portion, said fulcrum portion and said connection portion being arranged substantially in the form of a crank, and the contacts of the other kind each comprising an elastic portion and a fulcrum portion between the contact portion and a connection portion, and a pressure receiving portion extending from said elastic portion in the opposite direction from the contact portion, and said contact portion, said elastic portion, said fulcrum portion, and said connection portion being arranged substantially in the form of a U-shape, and said slider is provided with pushing portions arranged continuously in its longitudinal direction and mounted on said housing so that said pushing portions are pivotally movable between the connection portions and the pressure receiving portions of the contacts of the one kind and between the pressure receiving portions of the contacts of the other kind and said housing. Claim 3 recites the connector claimed in claim 1, wherein when the pushing portions of said slider are pivotally moved between the connection portions and the pressure receiving portions of said contacts of the one kind, said pressure receiving portions are raised by the pushing portions so that said elastic portions are tilted about said fulcrum portions toward said contact portions to push said contact portions against said flexible printed circuit board or flexible flat cable. Claim 4 recites the connector claimed in claim 1 or 2, wherein the pressure receiving portions of said contacts of the one kind or the other kind are each provided at the tip with an extended portion so that the pushing portions of said slider are prevented from moving toward the connection portions of said contacts of the one kind. Claim 5 recites the connector claimed in claim 1 or 2, wherein the pushing portions of said slider are of an elongated shape. Claim 6 recites the connector claimed in claim 5, wherein said slider is formed with a required number of anchoring holes independent from one another, which are adapted to engage the extended portions of said contacts, respectively. Claim 7 recites the connector claimed in claim 5, wherein the elongated shape of said pushing portions is elliptical. Claim 8 recites the connector claimed in claim 1, wherein said contacts of the one kind are each provided with a further contact portion at a location extending from the fulcrum portion and adapted to contact said flexible printed circuit board or flexible flat cable. Claim 9 recites the connector claimed in claim 2, wherein said contacts of the other kind are each provided with an extension portion extending from said fulcrum in the opposite direction from the connection portion, and said slider is mounted on said housing so that the pushing portions of said slider are pivotally movable between the extension portions and the pressure receiving portions. Claim 10 recites the connector claimed in claim 2, wherein said contacts of the other kind are each further provided between the fulcrum portion and the connection portion with a contact portion adapted to contact said flexible printed circuit board or flexible flat cable.

Patent Literature 2

According to the abstract of the Japanese Patent Application Opened No. 2004-206,987, this invention has an object to provide a connector enabling narrow pitches and being used with a flexible printed circuit board having contact portions on both surfaces. Disclosed is a connector including a required number of contacts each having a contact portion 52 adapted to contact a flexible printed circuit board 22, and a housing 12 for holding and fixing the contacts and having a fitting opening 24 for inserting the flexible printed circuit board 22, wherein when the flexible printed circuit board 22 has contact portions 52 on both front and rear surfaces, contacts 14 and 16 of two kinds are used in a manner such that the contacts 14 of one kind are inserted into the housing from the opposite side of the fitting opening 24 so as to permit their contact portions 30 to contact the contact portions 52 on the front surface of the circuit board 22, and the contacts 16 of the other kind are inserted into the housing 12 from the side of the fitting opening 24 so as to permit their contact portions 20 to contact the contact portions 52 on the rear surface of the circuit board 22.

By the way, claim 1 of the Japanese Patent Application Opened No. 2004-206,987 recites a connector detachably fitted with a flexible printed circuit board (FPC) including a required number of contacts each having a contact portion adapted to contact said flexible printed circuit board, a housing holding and fixing said contacts and having a fitting opening for inserting the flexible printed circuit board, wherein when the flexible printed circuit board has contact portions on both front and rear surfaces, contacts of two kinds are used in a manner such that the contacts of one kind are inserted into the housing from the opposite side of the fitting opening so as to permit their contact portions to contact the contact portions on the front surface of the circuit board, and the contacts of the other kind are inserted into the housing from the side of the fitting opening so as to permit their contact portions to contact the contact portions on the rear surface of the circuit board. Claim 2 recites the connector claimed in claim 1, wherein a pair of contacts are formed by two contacts of the two kinds and arranged so that their contact portions are facing to each other so as to embrace said flexible printed board by the opposite contact portions of the respective pairs. Claim 3 recites the connector claimed in claim 2, wherein the contact portions of the pairs of contacts are staggered with respect to the longitudinal direction. Claim 4 recites the connector claimed in claim 3, wherein said housing is provided with a recess on the side of said fitting opening for conducting said flexible printed circuit board, the contacts of the other kind are arranged such that their connection portions do not extend from the recess of said housing. Claim 5 recites the connector claimed in claim 4, wherein in order to form a zero insertion-force (ZIF) structure which does not require a force when said flexible printed circuit board is inserted into the housing, a slider is used which is pushed against the contacts after said flexible printed circuit board has been inserted into the housing. Claim 6 recites the connector claimed in claim 5, wherein the contacts of the one kind each includes an elastic portion and a fulcrum portion between the contact portion and the connection portion, and a pressure receiving portion extending from said elastic portion at a location facing to said connection portion, and said contact portion, said elastic portion, said fulcrum portion, and said connection portion being substantially in the form of a crank, and the contacts of the other kinds each includes a contact portion and a connection portion and are so arranged that their connection portions are in the recess of said housing, and wherein said slider is provided with pushing portions arranged continuously in its longitudinal direction and said slider is mounted on said housing so as to permit said pushing portions to be pivotally movable between the connection portions and the pressure receiving portions of the contacts of the one kind.

Patent Literature 3

According to the abstract of the Japanese Patent Application Opened No. 2004-221,067, the object of this invention is to provide a connector 10 ensuring a required holding force for a flexible printed circuit board 22 without any defective or failed connection even with less conductors. Disclosed is a connector 10 detachably fitted with a flexible printed circuit board 22, including a required number of contacts 14 each having a contact portion 30 adapted to contact the flexible printed circuit board 22, and a housing 12 holding and fixing the contacts 14 and having a fitting opening 24 into which the flexible printed circuit board 22 is inserted, wherein the circuit board 22 is provided with anchoring portions 54, and locking members 20 each having an engaging portion 56 adapted to engage said anchoring portion 54 of the circuit board are installed into the housing 12 so that the engaging portions 56 of the locking members 20 are caused to engage the anchoring portions 54 of the circuit board 22, thereby preventing the circuit board 22 from being removed from the housing 12, and grooves 57 are provided at positions corresponding to said engaging portions 56 to ensure a more reliable locking.

By the way, claim 1 of the Japanese Patent Application Opened No. 2004-221,067 recites a connector detachably fitted with a flexible printed circuit board, including a required number of contacts each having a contact portion to contact said flexible printed circuit board, and a housing holding and fixing the contacts and having a fitting opening into which said flexible printed circuit board is inserted, wherein said flexible printed circuit board is provided with anchoring portions, and locking members each having an engaging portion adapted to engage said anchoring portion of said circuit board are installed in said housing so that the engaging portions of said locking members are caused to engage the anchoring portions of said circuit board, thereby preventing the circuit board from being removed from said housing. Claim 2 recites the connector claimed in claim 1, wherein grooves are provided at locations facing to said engaging portions. Claim 3 recites the connector claimed in claim 1 or 2, wherein said locking members are each provided with a connection portion for connecting to the circuit board so that the connection portions serve to fix the locking members to the circuit board. Claim 4 recites the connector claimed in claim 1 or 2, wherein in order to form a zero insertion-force (ZIF) structure which does not require a force when said flexible printed circuit board is inserted into the fitting opening of said housing, a slider is used which is pushed against said contacts after said flexible printed circuit board has been inserted into the housing, and the engaging portions of said locking members are caused to engage the anchoring portions of said flexible printed circuit board when the circuit board is pushed against said contacts by said slider. Claim 5 recites the connector claimed in any one of claims 2, 3 and 4, wherein said grooves are provided in a manner such that flat portions of said engaging portions engage said anchoring portions when the engaging portions of said locking portions engage the anchoring portions of said flexible printed circuit board. Claim 6 recites the connector claimed in claim 5, wherein said housing is provided on the side of said fitting opening with a recess for conducting said flexible printed circuit board, and said contacts are so arranged in said housing that the connection portions of said contacts do not extend out of the recess of said housing. Claim 7 recites the connector claimed in claim 6, wherein contacts of two kinds are arranged to be staggered so that connection portions of the contacts of the one kind are arranged on the opposite side of the fitting opening of said housing, and connection portions of the contacts of the other kind and of said locking members are arranged so as not to extend from the recess of said housing. Claim 8 recites the connector as claimed in claim 7, wherein the contacts of the one kind each comprise an elastic portion and a fulcrum portion between the contact portion and the connection portion, and an extension portion extending from said elastic portion at a location facing to said connection portion, and said contact portion, said elastic portion, said fulcrum portion, and said connection portion being arranged substantially in the form of a crank, and the contacts of the other kind each comprise an elastic portion and a fulcrum portion between the contact portion and the connection portion, a pressure receiving portion extending from said elastic portion in the opposite direction from the contact portion, and an extension portion extending from said fulcrum portion to be facing to the pressure receiving portion, and said contact portion, said elastic portion, said fulcrum portion, and said connection portion being arranged substantially in the form of a U-shape, and the contacts of the other kind are arranged so that said connection portions are within the recess of said housing, and wherein said slider is provided with pushing portions arranged continuously in its longitudinal direction, and said slider is mounted on said housing so that said pushing portions are pivotally movable between the connection portions and the pressure receiving portions of the contacts of the one kind and between the pressure receiving portions and the extension portions of the contacts of the other kind. Claim 9 recites the connector claimed in claim 8, wherein said locking members are the same in construction as the contacts of the other kind.

Patent Literature 4

According to the abstract of the Japanese Patent Application Opened No. 2006-147,271, this invention has an object to provide a connector ensuring a stable holding force for a flexible printed circuit board, even the connector having a small number of conductors, without causing defective or failed connection, and achieving a more reduced overall height of the connector. Disclosed is a connector for achieving this object, wherein a flexible printed circuit board 80 is provided with anchoring portions 82, locking members each includes a first piece 20 having at one end an engaging portion 24 adapted to engage the anchoring portion 82, at the other end a pressure receiving portion 26 to be pushed by a pivoting member, and an extended portion 34 inwardly extending from the tip of the pressure receiving portion 26, a second piece 22 having at one end a connection portion 30 to be connected to a substrate, and a jointing fulcrum portion 32 for jointing the first piece 20 and the other end of the second piece 22, and the locking members are installed in the housing 12 so that when the pivoting member 16 is pivotally moved to cause the engaging portions 24 of the locking members 18 to engage the anchoring portions 82 of the flexible printed circuit board 82, there are not the second pieces 22 at locations facing to the engaging portions 24, and the housing 12 is provided with notches 42 at locations corresponding to the locking members 18.

By the way, claim 1 of the Japanese Patent Application Opened No. 2006-147,271 recites a connector detachably fitted with a flexible printed circuit board (FPC), including a plurality of contacts each having a contact portion adapted to contact said flexible printed circuit board, a housing holding and fixing said contacts and having a fitting opening into which said flexible printed circuit board is inserted, locking members adapted to engage said flexible printed circuit board, and a pivoting member for elastically deforming said contacts and said locking members, wherein said flexible printed circuit board is provided with anchoring portions, and said locking members each comprise a first piece having at one end an engaging portion adapted to engage said anchoring portion, at the other end a pressure receiving portion to be pushed by said pivoting member, and an extended portion extending inwardly from a tip of said pressure receiving portion, a second piece having at one end or the other end a connection portion to be connected to a substrate, and a jointing fulcrum portion for jointing said first piece and the other end or one end of said second piece, and wherein said locking members are installed in said housing, and said housing is provided with notches at locations corresponding to said locking members on the side of the upper surface of said housing. Claim 2 recites a connector detachably fitted with a flexible printed circuit board (FPC), including a plurality of contacts each having a contact portion adapted to contact said flexible printed circuit board, a housing holding and fixing said contacts and having a fitting opening into which said flexible printed circuit board is inserted, locking members adapted to engage said flexible printed circuit board, and a pivoting member for elastically deforming said contacts and said locking members, wherein said flexible printed circuit board is provided with anchoring portions, and said locking members each comprise a first piece having at one end an engaging portion adapted to engage said anchoring portion, at the other end a pressure receiving portion to be pushed by said pivoting member, and an extended portion extending inwardly from a tip of said pressure receiving portion, a second piece having at one end a connection portion to be connected to a substrate, and a jointing fulcrum portion for jointing said first piece and the other end of said second piece, and wherein said locking members are installed in said housing, and when said pivoting member is pivotally moved to cause the engaging portions of said locking members to engage the anchoring portions of said flexible printed circuit board, there are not said second pieces at locations facing to said engaging portions. Claim 3 recites the connector claimed in claim 2, wherein the height of said second pieces is 0.08 to 0.12 mm. Claim 4 recites the connector claimed in claim 2 or 3, wherein said second pieces are each provided with an extension portion extending from said jointing fulcrum portion in a direction so as to face to said engaging portion, said extension portion being shorter than the engaging portion of said first piece so that the extension portion does not come to a position facing to said engaging portion when said pivoting member is pivotally moved to cause the engaging portions of said locking members to engage the anchoring portions of said flexible printed circuit board. Claim 5 recites the connector claimed in claim 4, wherein the locking members are each provided with a fixing portion between the tip of the extension portion of said second piece and said jointing fulcrum portion. Claim 6 recites the connector claimed in any one of claims 1 to 5, wherein said contacts each comprise a first piece having at one end a contact portion adapted to contact said flexible printed circuit board, at the other end a pressure receiving portion to be pushed by said pivoting member, and an extended portion inwardly extending from the tip of said pressure receiving portion, a second piece having at one end a connection portion to be connected to a substrate and at the other end an extension portion extending from a fulcrum portion, and a jointing portion for jointing said first piece and the fulcrum portion of said second piece, and said contact portion, said jointing portion, said fulcrum portion, and said connection portion being arranged substantially in the form of a U-shape, and, wherein said pivoting member comprises an actuating member for pivotally moving it, pushing portions provided continuously in the longitudinal direction, and anchoring holes for receiving the pressure receiving portions of said contacts and said locking members, and said pivoting member is mounted on said housing so that said pushing portions are pivotally movable between the pressure receiving portions and the extension portions of said contacts and between the pressure receiving portions and the connection portions of said locking members.

With the so-called rear-locking type connectors (pivotally moving a pivoting member on the opposite side of the fitting opening to push contacts against a connecting object) such as those disclosed in the Patent Literatures 1 to 4, when the pushing portions of a pivoting member are pivotally moved between the connection portions and the pressure receiving portions of the contacts after a connecting object such as a flexible printed circuit board or flexible flat cable has been inserted into the fitting opening of a housing, the pressure receiving portions are raised upwardly (lifted upwardly) by the pushing portions so that elastic portions of the contacts are tilted toward contact portions about fulcrum portions of the contacts, whereby the contact portions are pushed against the connecting object such as the flexible printed circuit board or flexible flat cable to bring the contact portions of the contacts into contact with the connecting object.

With the so-called rear locking type connectors as disclosed in the Patent Literatures 1 to 4, when the pressure receiving portions are pushed by the pushing portions of the pivoting member, the pressure receiving portions of the contacts are raised upwardly (upwardly viewed in FIG. 10) so as to push the contact portions against the connecting object as described above. However, when the contact portions of the contacts are pushed against the connecting object in this manner, the contact portions are raised upwardly (upwardly viewed in FIG. 10) about fixed portions of the contacts as fulcrums by a reaction force derived from the connecting object such as the flexible printed circuit board or flexible flat cable, and the elastic portions are also raised upwardly (upwardly viewed in FIG. 10), with the result that the function described above for bringing the contact portions of the contacts into contact with the connecting object would be inhibited and the connection between the contacts and the connecting object would become unstable. These problems remain to be solved.

With the connector having the upper and lower contacts of two kinds as disclosed in the Patent Literature 2, a connecting object is embraced by the upper and lower contacts by pushing the upper contacts against the connecting object so that the aforementioned problems are particularly acute. In more detail, when the upper contacts are raised upwardly (upwardly viewed in FIG. 10), the pushing force becomes weak so that the upper and lower contacts could not embrace the connecting object, thereby resulting in a more unstable connection between the connecting object and the contacts to give rise to a problem.

Even with the case using the locking members having the construction the same as that of the contacts as disclosed in the Patent Literatures 3 and 4, there would be a possibility of the engaging portion engaging a connecting object being raised upwardly (upwardly viewed in FIG. 10) in the same manner as described above so that there is a risk that the holding force for the connecting object becomes weak.

In recent years, the requirements for more reduced overall height and more miniaturization have put severe pressure on connectors. In the case that patterns are provided in a row only one surface of a flexible printed circuit board, pitches of patterns of less than 0.4 mm are generally impossible. In order to comply with the requirement for narrower pitches, it may be considered to arrange patterns to be alternately staggered. Even with the patterns arranged to be alternately staggered, however, pitches of patterns of less than 0.25 mm are impossible. In the case of patterns arranged to be staggered, moreover, if a fitting depth is selected to be shorter in order to achieve a reduced overall height and a more miniaturization of the connector, there would be a risk of contacts being dislodged from the patterns, resulting in defective or failed electrical connection. In recent years, there have been increasing demands for more reduced overall height and more miniaturization of connectors and at the same time even stronger holding-force for flexible printed circuit boards.

SUMMARY OF THE INVENTION

In view of the problems with the prior art described above, the invention has been completed and the invention has an object to provide a connector which provides a stable electrical connection without contacts being warped or deformed when a pivoting member is being pivotally moved, ensures a sufficient holding force for a flexible printed circuit board, and simultaneously enables a reduced overall height of the connector and a high density of the conductors.

The object of the invention described above is achieved by the connector 10 including a required number of contacts each having a contact portion 22 adapted to contact a connecting object, and a connection portion 24 to be connected to a substrate, a housing 12 having inserting holes 38 for arranging and holding said contacts inserted in said inserting holes and a fitting opening 18 into which said connecting object is inserted, and a pivoting member 16 mounted on said housing 12 on the opposite side of said fitting opening 18 and causing said contacts to be elastically deformed so as to push said contacts against said connecting object, wherein said contacts consist of two kinds of first contacts 14 and second contacts 15, and a first contact 14 and a second contact 15 are arranged in one and the same inserting hole 38 of said housing 12 so that the contact portions 22 of the first and second contacts 14 and 15 are facing to each other, wherein said first contacts 14 each comprise the contact portion 22 at one end and the connection portion 24 at the other end, and said second contacts 15 each comprise a first piece 19 having the contact portion 22 at one end and a pressure receiving portion 20 at the other end, a second piece 21 having the connection portion 24 at an outer end, and an elastic jointing-portion 31 (consisting of a fulcrum portion 32 and an elastic portion 34) for jointing said first piece 19 and the remaining end of said second piece 21, wherein said pivoting member 16 comprises an actuating portion 37 for pivotally moving said pivoting member 16, pushing portions 36 provided continuously in the longitudinal direction of the pivoting member, and anchoring holes 30 independent from one another for receiving therein said pressure receiving portions 20, respectively, and said pushing portions 36 are pivotally movable between said pressure receiving portions 20 and said connection portions 24 of said second contacts 15, during which pivotal movement, the axis 50 of rotation of said pushing portions 36 is moved with their pivotal movement to achieve their compact rotation, and wherein said second contacts 15 are each provided on said second piece 21 with a fixing portion 42 located in the proximity of said elastic jointing-portion 31, thereby preventing said second contacts 15 from being warped when said pivoting member 16 is being pivotally moved.

The connector 10 is so constructed in claim 2 that said connecting object is provided with anchoring portions 82 on both sides in its width direction, and locking members 17 each having engaging portion 56 adapted to engage said anchoring portion 82 are installed in said housing 12, and that said locking members 17 each comprise a first piece 191 having said engaging portion 56 at one end and a pressure receiving portion 201 at the other end, a second piece 211 having a connection portion 241 at an outer end, and an elastic jointing-portion 311 (consisting of a fulcrum portion 321 and an elastic portion 341) for jointing said first piece 191 and the remaining end of said second piece 211, and said locking members 17 are each further provided on said second piece 211 with a fixing portion 421 located in the proximity of said elastic jointing-portion 311.

Moreover, the connector 10 is so constructed in claim 3 that under a state that said connecting object is not inserted into said fitting opening 18 of said housing 12, the contact portions 22 of said second contacts 15 are in said inserting holes 38 without extending beyond the upper surface 57 of said fitting opening 18 into said fitting opening 18, and the contact portions 22 of said first contacts 14 extend beyond the lower surface 58 of said fitting opening 18 into said fitting opening 18 so that the distance between tips of the contact portions 22 of said first contacts 14 and the upper surface 57 of said fitting opening 18 is smaller than the thickness of said connecting object, and that under a state that said connecting object has been inserted into said fitting opening 18 of said housing 12 and said pivoting member 16 has been pivotally moved (closed), said connecting object remains in contact with the contact portions 22 of said first contacts 14 without said connecting object being raised upwardly beyond the upper surface 57 of the fitting opening 18 of said housing 12 even when said connecting object is accidentally subjected to an external force.

As can be seen from the above descriptions, the connector 10 according to the invention can bring about the following significant effects.

(1) In the connector 10 including a required number of contacts each having a contact portion 22 adapted to contact a connecting object, and a connection portion 24 to be connected to a substrate, a housing 12 having inserting holes 38 for arranging and holding said contacts inserted in said inserting holes and a fitting opening 18 into which said connecting object is inserted, and a pivoting member 16 mounted on said housing 12 on the opposite side of said fitting opening 18 and causing said contacts to be elastically deformed so as to push said contacts against said connecting object, according to the invention the connector is so constructed that said contacts consist of two kinds of first contacts 14 and second contacts 15, and a first contact 14 and a second contact 15 are arranged in one and the same inserting hole 38 of said housing 12 so that the contact portions 22 of the first and second contacts 14 and 15 are facing to each other, that said first contacts 14 each comprise the contact portion 22 at one end and the connection portion 24 at the other end, and said second contacts 15 each comprise a first piece 19 having the contact portion 22 at one end and a pressure receiving portion 20 at the other end, a second piece 21 having the connection portion 24 at an outer end, and an elastic jointing-portion 31 (consisting of a fulcrum portion 32 and an elastic portion 34) for jointing said first piece 19 and the remaining end of said second piece 21, that said pivoting member 16 comprises an actuating portion 37 for pivotally moving said pivoting member 16, pushing portions 36 provided continuously in the longitudinal direction of the pivoting member, and anchoring holes 30 independent from one another for receiving therein said pressure receiving portions 20, respectively, and said pushing portions 36 are pivotally movable between said pressure receiving portions 20 and said connection portions 24 of said second contacts 15, during which pivotal movement, the axis 50 of rotation of said pushing portions 36 is moved with their pivotal movement to achieve their compact rotation, and that said second contacts 15 are each provided on said second piece 21 with a fixing portion 42 located in the proximity of said elastic jointing-portion 31, thereby preventing said second contacts 15 from being warped when said pivoting member 16 is being pivotally moved. Therefore, even when the pivoting member 16 is being pivotally moved, said elastic jointing portions 31 are not raised upwardly (warped) and hence the contact portions 22 of said contacts 15 are not raised upwardly, thereby achieving a stable electrical connection. At the same time, since the connector according to the invention can be used with a flexible printed circuit board 80 having contacts on both surfaces, a high density of the contacts becomes possible on the order of pitches of 0.2 mm for both the surfaces of the circuit board.

(2) The connector 10 is so constructed in claim 2 that said connecting object is provided with anchoring portions 82 on both sides in its width direction, and locking members 17 each having engaging portion 56 adapted to engage said anchoring portion 82 are installed in said housing 12, and that said locking members 17 each comprise a first piece 191 having said engaging portion 56 at one end and a pressure receiving portion 201 at the other end, a second piece 211 having a connection portion 241 at an outer end, and an elastic jointing-portion 311 (consisting of a fulcrum portion 321 and an elastic portion 341) for jointing said first piece 191 and the remaining end of said second piece 211, and said locking members 17 are each further provided on said second piece 211 with a fixing portion 421 located in the proximity of said elastic jointing-portion 311. Consequently, even when the pivoting member 16 is being pivotally moved, said elastic jointing portions 31 are not raised upwardly (warped) and hence the engaging portions 56 of said locking members 17 are not raised upwardly, thereby achieving a stable holding force. At the same time, since the connector according to the invention can be used with a flexible printed circuit board 80 having contacts on both surfaces, a high density of the contacts becomes possible on the order of pitches of 0.2 mm for both the surfaces of the circuit board. Moreover, by using the locking members 17, the holding force for the circuit board is further increased.

(3) The connector 10 is so constructed in claim 3 that under a state that said connecting object is not inserted into said fitting opening 18 of said housing 12, the contact portions 22 of said second contacts 15 are in said inserting holes 38 without extending beyond the upper surface 57 of said fitting opening 18 into said fitting opening 18, and the contact portions 22 of said first contacts 14 extend beyond the lower surface 58 of said fitting opening 18 into said fitting opening 18 so that the distance between tips of the contact portions 22 of said first contacts 14 and the upper surface 57 of said fitting opening 18 is smaller than the thickness of said connecting object, and that under a state that said connecting object has been inserted into said fitting opening 18 of said housing 12 and said pivoting member 16 has been pivotally moved (closed), said connecting object remains in contact with the contact portions 22 of said first contacts 14 without said connecting object being raised upwardly beyond the upper surface 57 of the fitting opening 18 of said housing 12 even when said connecting object is accidentally subjected to an external force. Accordingly, even when the pivoting member 16 is being pivotally moved, said elastic jointing portions 31 are not raised upwardly (warped) and hence the contact portions 22 of said contacts 15 are not raised upwardly, thereby achieving a stable electrical connection. At the same time, since the connector according to the invention can be used with a flexible printed circuit board 80 having contacts on both surfaces, a high density of the contacts becomes possible on the order of pitches of 0.2 mm for both the surfaces of the circuit board. Further, even if the circuit board is subjected to an accidental external force, the minimum contact force between the circuit board and the contact portions 22 of said first contacts 14 is ensured so that a stable electrical connection is obtained between the connecting object and the contacts 14 and 15.

The invention will be more fully understood by referring to the following detailed specification and claims taken in connection with the appended drawings.

DESCRIPTION OF THE PREFERRED EMBODIMENTS

Figure 1A:
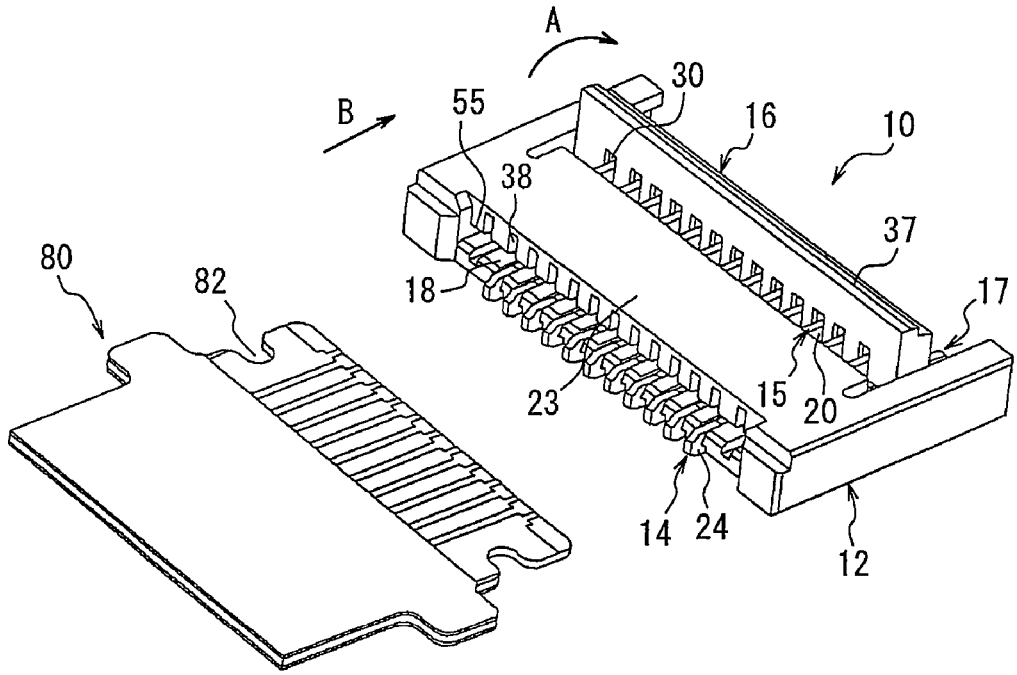
FIG. 1A is a perspective view of the connector according to the invention and a flexible printed circuit board viewed from the above on the side of the fitting opening.

The subject feature of the invention lies in the fact that in the case of inserting two kinds of contacts (first contact 14 and second contact 15) into one of inserting holes 38 formed in a housing 12 to use these contacts as upper and lower contacts, contact portions 22 of the second contacts 15 and elastic jointing-portions 31 (including fulcrum portions 32 and elastic portions 34) are prevented from being raised (warped) when a pivoting member 16 is being pivotally moved. In other words, by preventing the contact portions 22 and the elastic jointing-portions 31 (including fulcrum portions 32 and elastic portions 34) of the second contacts 15 from being raised (warped), the invention provides a connector which enables the stable electrical connection and the sufficient holding force with a flexible printed circuit board and achieves a reduced overall height and a high density of conductors. Namely, for this purpose, the second pieces 21 of the second contacts 15 are each provided with a fixing portion 42 located in the proximity of the elastic jointing-portion 31.

One embodiment of the connector 10 according to the invention will be explained with reference to FIGS. 1A to 9E.

Figure 1B:
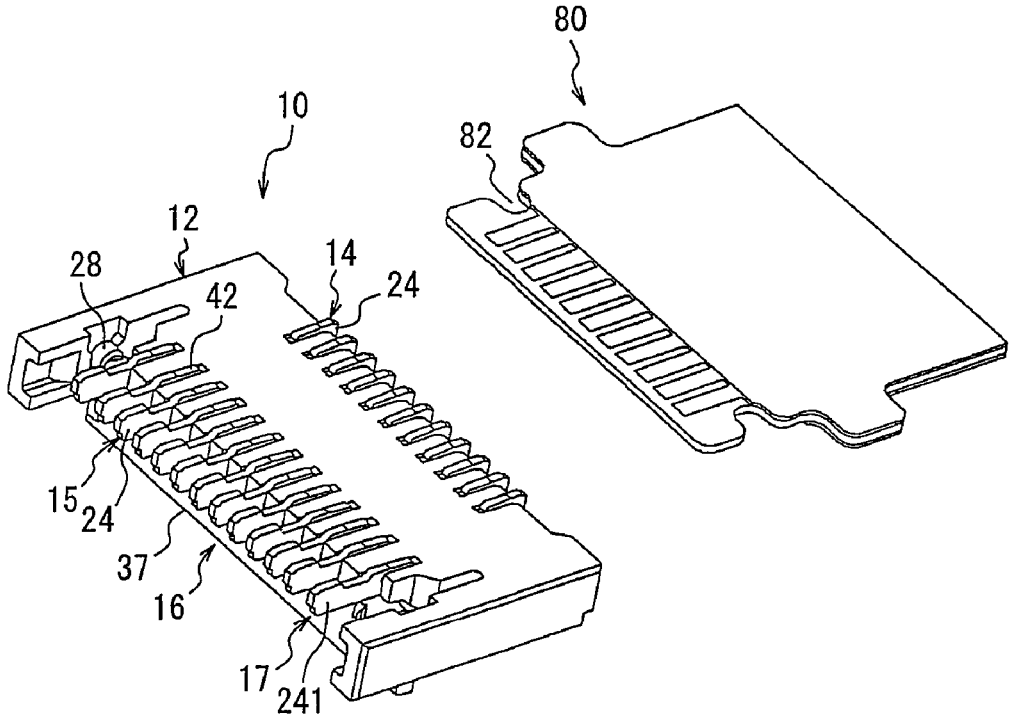
FIG. 1B is a perspective view of the connector according to the invention and the flexible printed circuit board viewed from the below on the opposite side of the fitting opening.
Figure 2A:
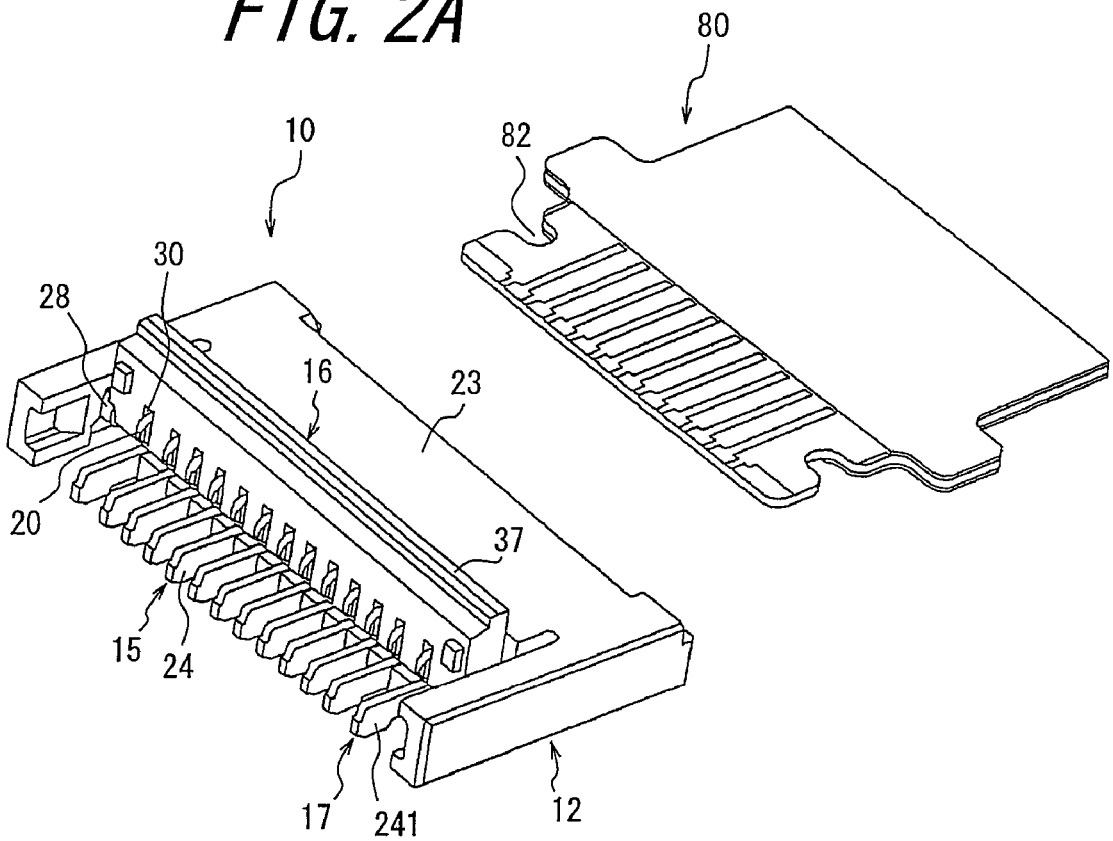
FIG. 2A is a perspective view of the connector according to the invention and the flexible printed circuit board viewed from the above on the opposite side of the fitting opening.
Figure 2B:
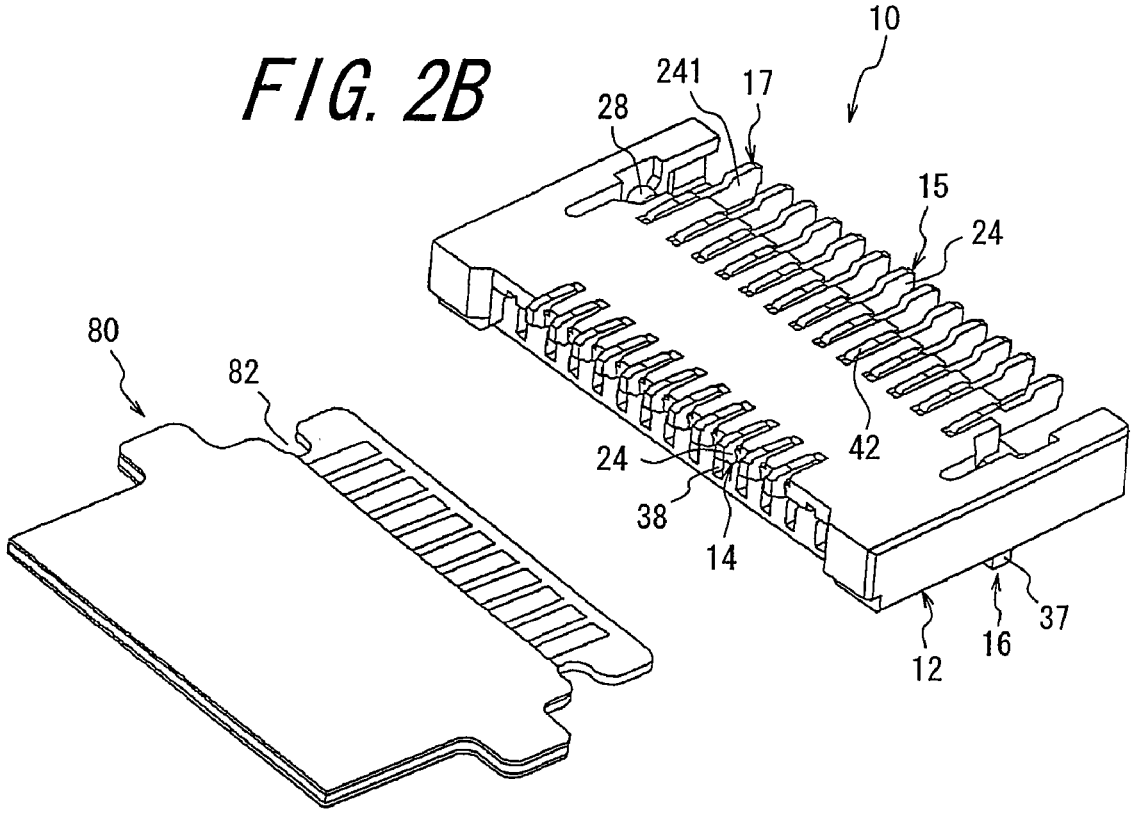
FIG. 2B is a perspective view of the connector according to the invention and the flexible printed circuit board viewed from the below on the side of the fitting opening.
Figure 3A:
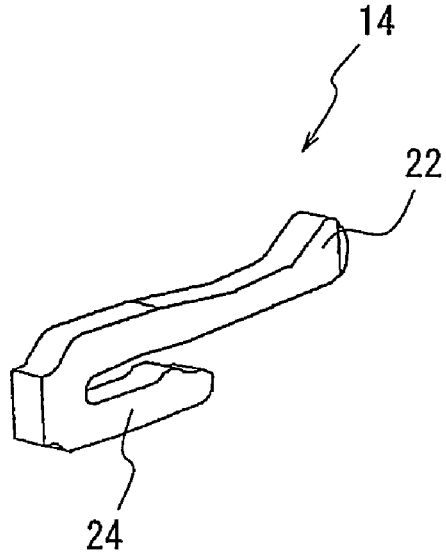
FIG. 3A is a perspective view of a first contact.
Figure 3B:
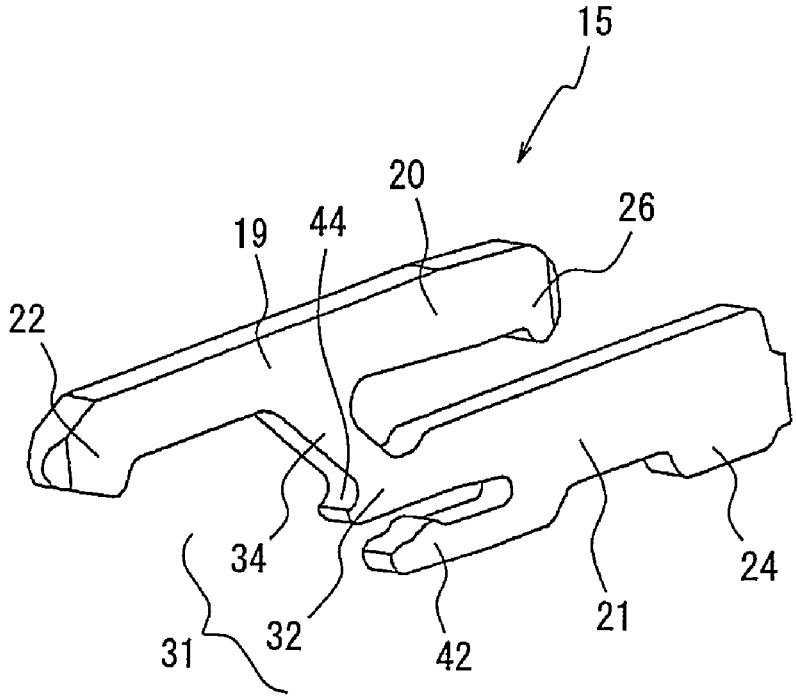
FIG. 3B is a perspective view of a second contact.
Figure 4:
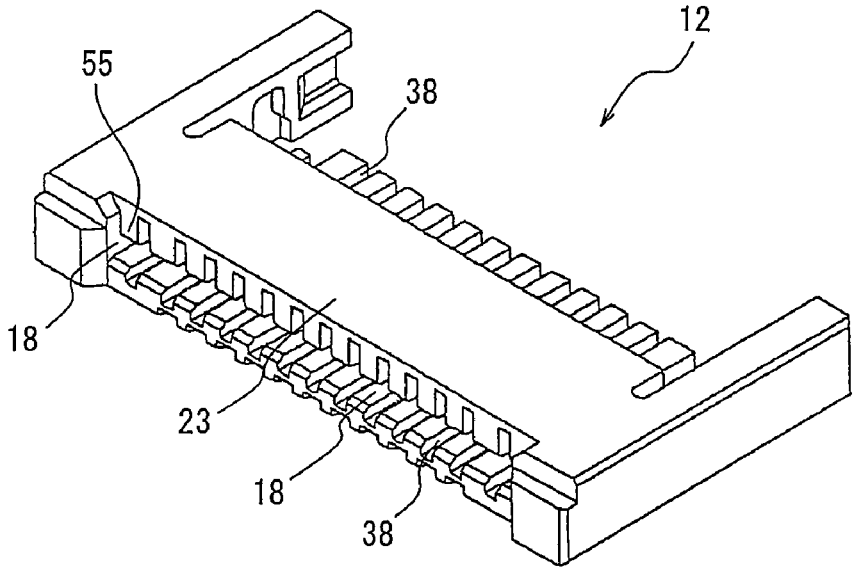
FIG. 4 is a perspective view of a housing.
Figure 5:
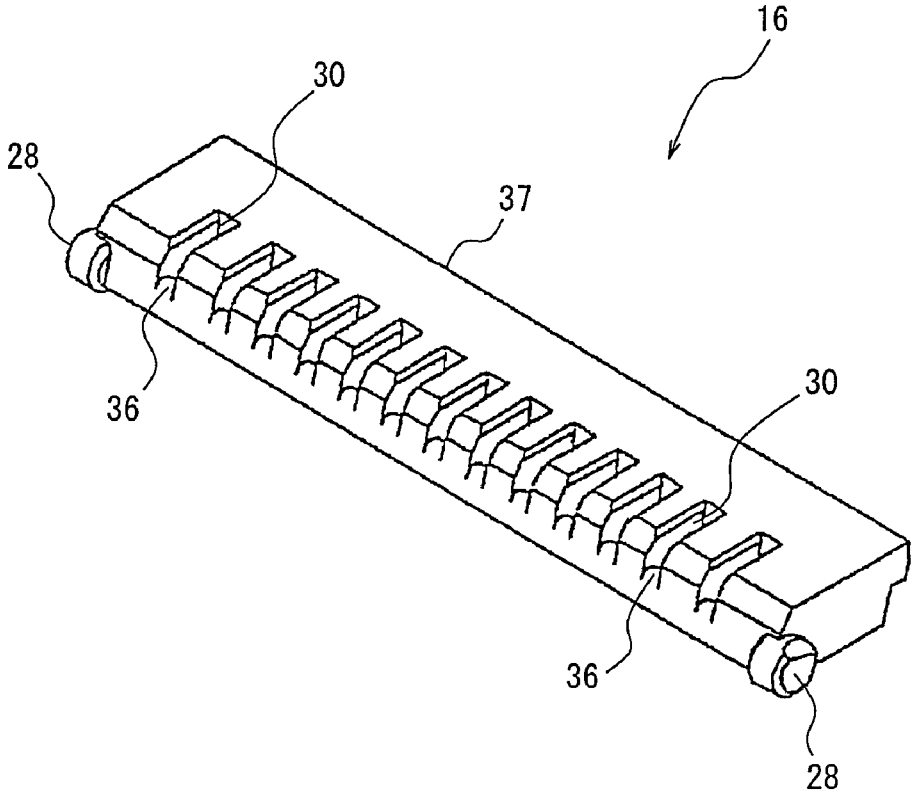
FIG. 5 is a perspective view of a pivoting member.
Figure 6:
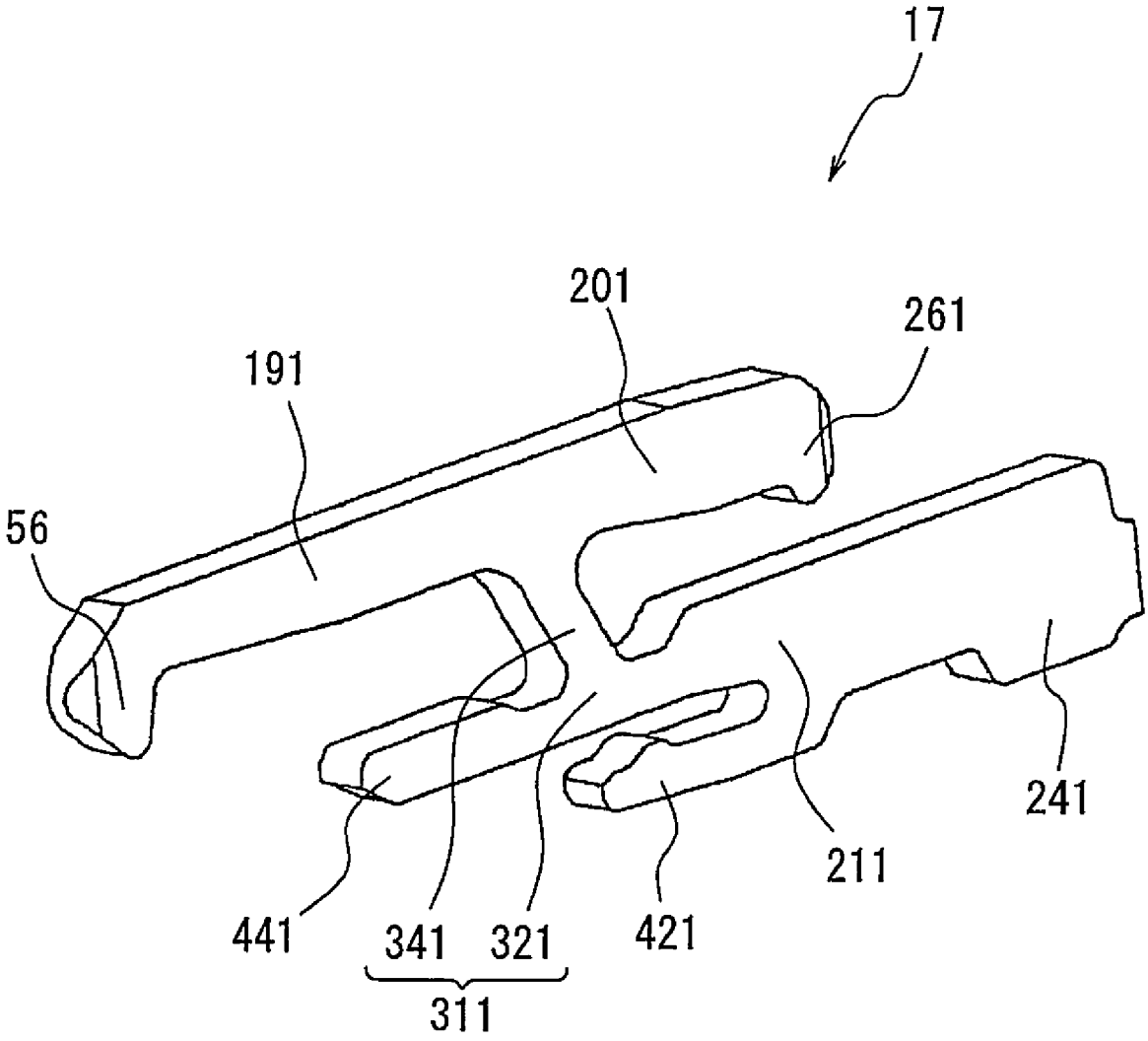
FIG. 6 is a perspective view of a locking member.
Figure 7A:
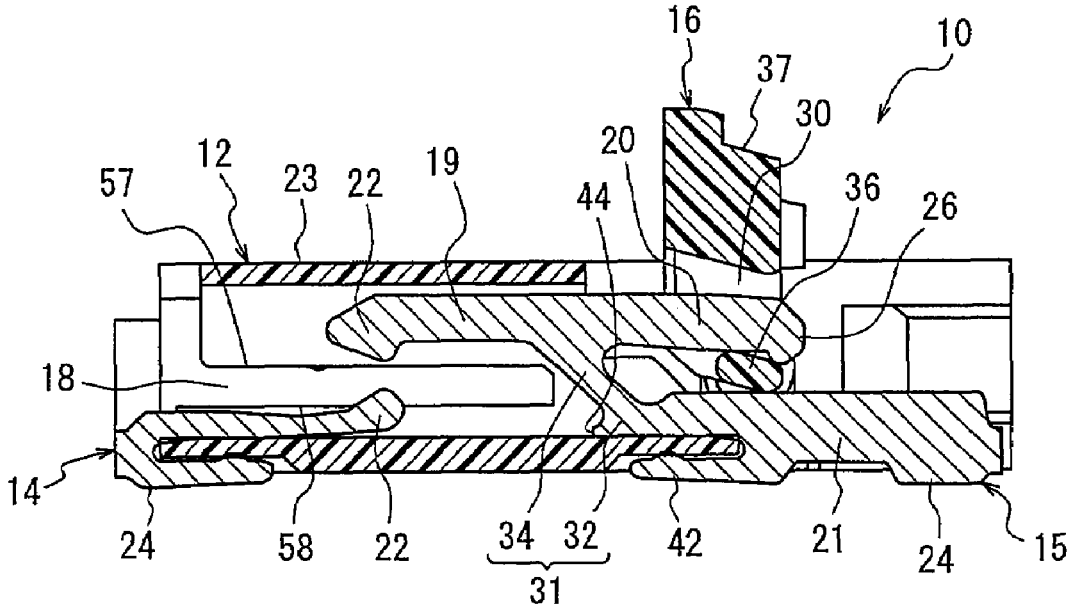
FIG. 7A is a sectional view of the connector with the pivoting member opened, taken along one inserting hole for contacts.
Figure 7B:
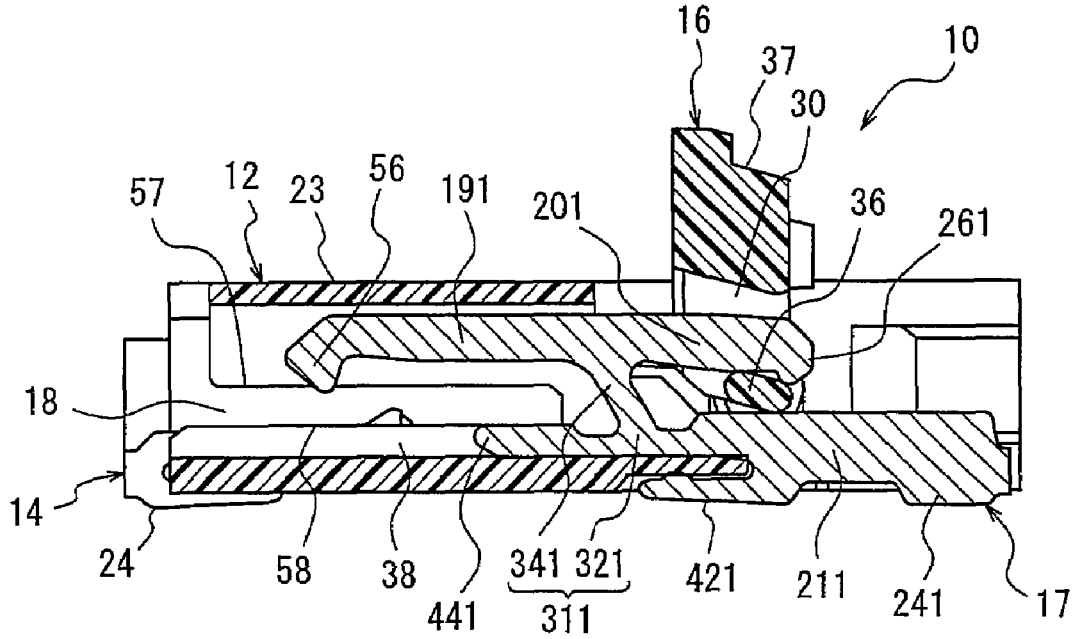
FIG. 7B is a sectional view of the connector with the pivoting member opened, taken along one inserting hole for the locking member.
Figure 8A:
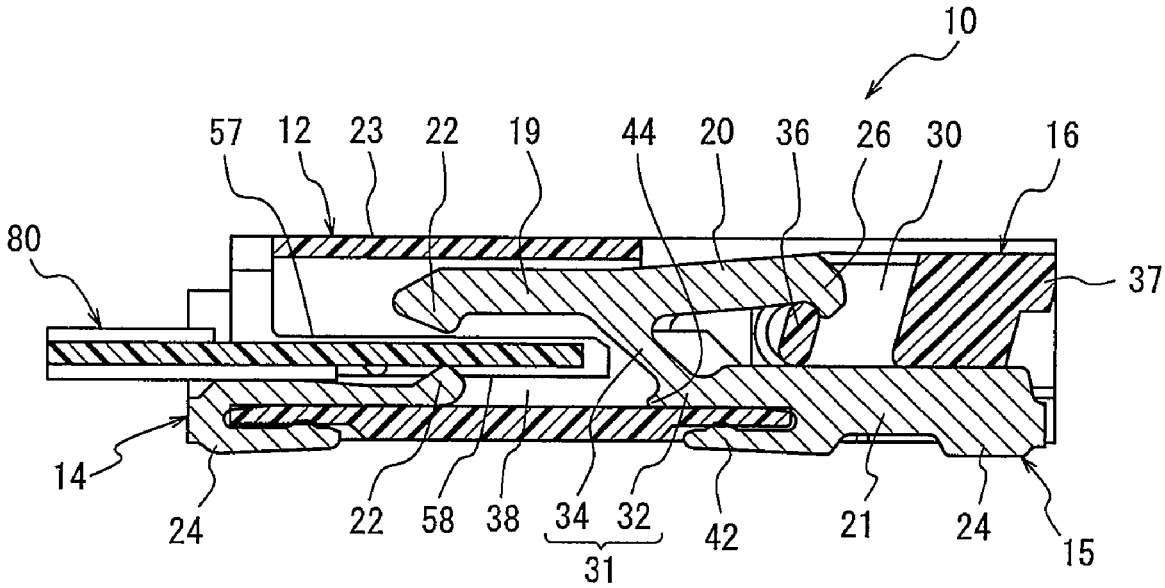
FIG. 8A is a sectional view of the connector with the pivoting member closed and with the flexible printed circuit board inserted, taken along one inserting hole for the contacts.
Figure 8B:
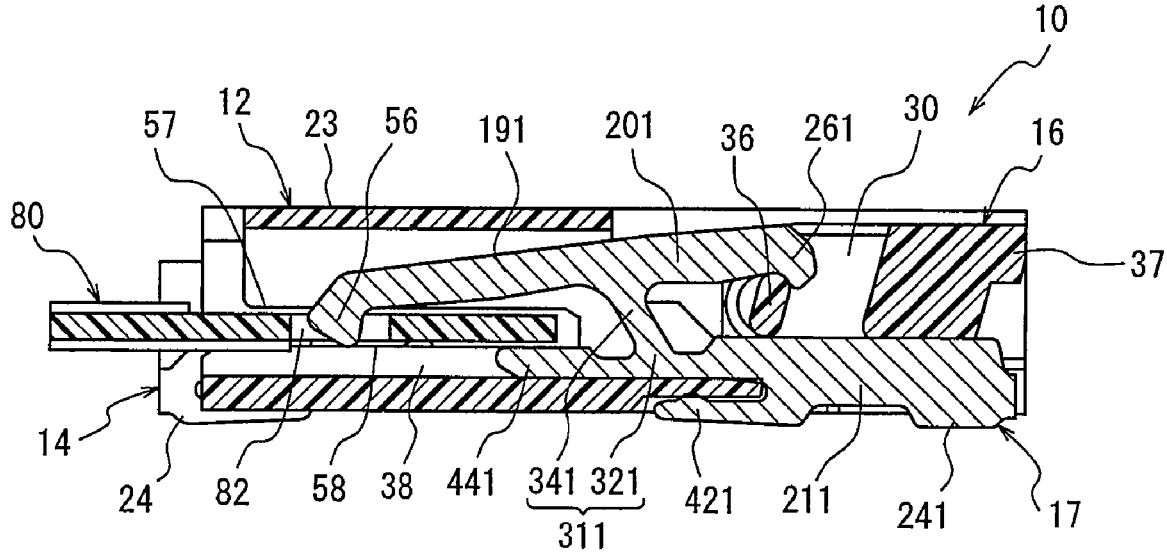
FIG. 8B is a sectional view of the connector with the pivoting member closed and with the flexible printed circuit board inserted, taken along one inserting hole for the locking member.

FIG. 1A is a perspective view of the connector according to the invention and a flexible printed circuit board viewed from the above on the side of the fitting opening, and FIG. 1B is a perspective view of the connector according to the invention and the flexible printed circuit board viewed from the below on the opposite side of the fitting opening. FIG. 2A is a perspective view of the connector according to the invention and the flexible printed circuit board viewed from the above on the opposite side of the fitting opening, while FIG. 2B is a perspective view of the connector according to the invention and the flexible printed circuit board viewed from the below on the side of the fitting opening. FIG. 3A is a perspective view of a first contact, while FIG. 3B is a perspective view of a second contact. FIG. 4 is a perspective view of a housing, while FIG. 5 is a perspective view of a pivoting member and FIG. 6 is a perspective view of a locking member. FIG. 7A is a sectional view of the connector with the pivoting member opened, taken along one inserting hole for the contacts, and FIG. 7B is a sectional view of the connector with the pivoting member opened, taken along one inserting hole for the locking member. FIG. 8A is a sectional view of the connector with the pivoting member closed and with the flexible printed circuit board inserted, taken along one inserting hole for the contacts, while FIG. 8B is a sectional view of the connector with the pivoting member closed and with the flexible printed circuit board inserted, taken along one inserting hole for a locking member. FIGS. 9A to 9E are explanatory views for explaining movements of a pushing portion and an axis of rotation when the pivoting member is being pivotally moved.

The connector 10 according to the invention mainly comprises a housing 12, first contacts 14, second contacts 15, a pivoting member 16, and locking members 17.

Components of the connector 10 according to the invention will be explained with reference to the drawings. First, the contacts will be explained. Both the first and second contacts 14 and 15 of the two kinds are made of a metal and formed by means of the press-working of the known technique. Preferred metals from which to form said contacts of the two kinds include brass, beryllium copper, phosphor bronze and the like which comply with the requirements as to springiness, electric conductivity and the like. In the illustrated embodiment, two contacts of the two kinds (first contact 14 and second contact 15) are into one and the same inserting hole 38 of the housing 12 in a manner such that the first contact 14 is inserted into the inserting hole from the side of the fitting opening 18 and the second contact 15 is inserted into the inserting hole from the opposite side of the fitting opening 18 to form an upper and lower contact structure.

Said first contact 14 is substantially i-shaped and comprises a contact portion 22 at one end and a connection portion 24 at the other end. The contact portion 22 is of a protruded shape for facilitating the contact with a connecting object such as a flexible printed circuit board or flexible flat cable. Although the connection portion 24 is of a surface mounting type (SMT) as shown in FIG. 3A, it may be a dip type. The contact portion 22 of the first contact 14 is arranged so as to be opposite (facing to) a contact portion 22 of the second contact 15.

The second contact 15 comprises at least a first piece 19 having a contact portion 22 at one end and a pressure receiving portion 20 at the other end, a second piece 21 having a connection portion 24 at its outer end, and an elastic jointing-portion 31 (consisting of a fulcrum portion 32 and an elastic portion 34) for jointing or connecting said first piece 19 and the remaining end of said second piece 21. The elastic jointing-portion 31 includes the fulcrum portion 32 and the elastic potion 34 in the illustrated embodiment. In other words, the second contact 15 is substantially inverted h-shaped as shown in FIG. 3B, and comprises the first piece 19 having at the one end the contact portion 22 adapted to contact the connecting object, at the other end the pressure receiving portion 20 to be pushed by the pivoting member 16, and an extended portion 26 inwardly extending from the tip of the pressure receiving portion 20, the second piece 21 having at one end the fulcrum portion 32 and at the other end the connection portion 24 to be connected to a substrate, the elastic portion 34 for jointing or connecting the substantially center of said first piece 19 and said fulcrum portion 32 of said second piece 21 (the elastic jointing-portion 31 consisting of said fulcrum portion 32 and said elastic portion 34), and a fixing portion 42 provided on said second piece 21 in the proximity of the elastic jointing-portion 31 of said second contact 15 and close to the main body of said second piece 21. Said contact portion 22 of said first piece 19, said elastic portion 34, said fulcrum portion 32, and said connection portion 24 are arranged substantially in the form of a crank.

Said fixing portion 42 is provided on said second piece 21 in the proximity of the elastic jointing-portion 31 of said second contact 15 and close to the main body of the second piece 21. In other words, the fixing portion 42 is located below the proximity of the fulcrum portion 32, thereby preventing the contact portion 22 and the elastic jointing-portion 31 (including the fulcrum portion 32 and the elastic portion 34) of said second contact 15 from being raised upwardly (warped). As shown in FIG. 7A, said fixing portion 42 forms with the main body of the second piece 21 a substantially U-shape and fixed to the housing 12 in a manner embracing part of the housing 12. The position and size of said fixing portion 42 may be suitably designed in consideration of these functions, holding force and the like.

Said contact portion 22 is of a protruded shape for facilitating the contact with a connecting object such as a flexible printed circuit board or flexible flat cable. Although the connection portion 24 is of a surface mounting type (SMT) as shown in FIG. 3B, it may be a dip type.

Said fulcrum portion 32, said elastic portion 34 and said pressure receiving portion 20 serve to achieve the following functions when a connecting object such as a flexible printed circuit board or flexible flat cable is inserted into the connector. After the connecting object such as the flexible printed circuit board or flat cable has been inserted into a fitting opening 18 of said housing 12, when pushing portions 36 of said pivoting member 16 are pivotally moved between the connection portions 24 and the pressure receiving portions 20 of said second contacts 15, said pressure receiving portions 20 are raised by the pushing portions 36 so that the elastic portions 34 of said second contacts are tilted toward said contact portions 22 about the fulcrum portions 32 of said second contacts 15, thereby causing said contact portions 22 to be pushed against the connecting object such as the flexible printed circuit board or flexible flat cable. The sizes, and shapes of said fulcrum portions 32, said elastic portions 34, and said pressure receiving portions 20 may be suitably designed so as to achieve such functions.

Moreover, the pressure receiving portion 20 of said second contact 15 is provided at its tip with the extended portion 26 as described above. When the pushing portions 36 of said pivoting member 16 are pivoted or pivotally moved between the pressure receiving portions 20 and the connection portions 24 of said second contacts 15, the center of said pivoting member 16 is often deformed in the direction shown by an arrow B in FIG. 1A due to strong reaction forces against the pivotal movement of said pivoting member 16. In this case, since the extended portions 26 engage anchoring holes 30 (later described) of the pivoting member 16, the deformation of the pivoting member 16 will be effectively prevented. The size of said extended portions 26 may be any one insofar as they can achieve the function described above, and may be suitably designed to an extent such that the pushing portions 36 of said pivoting member 16 can engage the extended portions 26. Moreover, said extended portions 26 serve to hold the pushing portions 36 of said pivoting member so as to prevent the pushing portions 36 from being tilted when said pivoting member has been completely pivotally moved and said contacts have contacted the connecting object.

It is preferable to provide an extension portion 44 (not shown) extending from said fulcrum portion 32 in the opposite direction (toward the fitting opening 18) from said connection portion 24 of the second contact 14, although the extension portion is not provided in the illustrated embodiment. A flux rise can be prevented by providing the extension portion 44 and by suitably setting a relation between said extension portion 44 and said first piece 19 respectively and the inserting hole 38 of said housing 12. In other words, the first piece 19 of the second contact 15 is inserted in said inserting hole 38 with a clearance, but said first piece 19 is inserted in said inserting hole 38 closely to an extent that a capillary phenomenon would occur. Therefore, the relation between said inserting hole 38 and said extension portion 44 closely inserted therein tends to cause a capillary phenomenon of the flux so that the flux flows along said extension portion 44 but does not flow upwardly toward said contact portion 22 where the capillary phenomenon does not occur. The length of said extension portions 44 may be suitably designed so as to perform the functions, and the extension portions may be sufficient to have a length of the order of 1.0 mm.

The flexible printed circuit board 80 will be explained before explaining the locking member 17. The flexible printed circuit board 80 mainly comprises contacts adapted to contact the contact portions 22 of said first and second contacts 14 and 15, patterns connected to circuits, and anchoring portions 82 adapted to engage engaging portions 56 of said locking members 17. The contacts of the flexible printed circuit board 80 are provided on both its surfaces in the illustrated embodiment. Said anchoring portions 82 may be of any shape insofar as the anchoring portions 82 engage the engaging portions 56 of the locking members 17 and may be a U-shaped notch or a through-hole, or a blind hole as the case may be.

The locking member 17 will be explained with reference to FIG. 6. The locking members 17 are also made of a metal and formed by means of the press-working of the known technique. Preferred metals from which to form the locking members are similar to those of said first and second contacts 14 and 15.

Said locking member 17 comprises at least a first piece 191 having the engaging portion 56 at one end and a pressure receiving portion 201 at the other end, a second piece 211 having a connection portion 241 at its outer end, and an elastic jointing-portion 311 (consisting of a fulcrum portion 321 and an elastic portion 341) for jointing or connecting said first piece 191 and the remaining end of said second piece 211. Said elastic jointing-portion 311 includes the fulcrum portion 321 and the elastic portion 341 in the illustrated embodiment. In other words, the locking member 17 is substantially inverted h-shaped as shown in FIG. 6, and comprises the first piece 191 having at one end the engaging portion 56 adapted to engage the anchoring portion 82 of said flexible printed circuit board 80, at the other end the pressure receiving portion 201 to be pushed by said pivoting member 16, and an extended portion 261 inwardly extending from the tip of the pressure receiving portion 201, the second piece 211 having at one end the fulcrum portion 321 and at the other end the connection portion 241 to be connected to the substrate, the elastic portion 341 for jointing or connecting the substantially center of said first piece 191 and said fulcrum portion 321 of said second piece 211 (the elastic jointing-portion 311 consisting of said fulcrum portion 321 and said elastic portion 341), and a fixing portion 421 provided on said second piece 211 in the proximity of the elastic jointing-portion 311 and close to the main body of said second piece 211. In the illustrated embodiment, there is provided an extension portion 441 extending from said fulcrum portion 321 toward the fitting opening 18. The extension portion 441 extends from said fulcrum portion 321 to a substantially intermediate position between said elastic portion 341 and said engaging portion 56. Said engaging portion 56 of said first piece 191, said elastic portion 341, said fulcrum portion 321, and said connection portion 241 are arranged substantially in the form of a crank.

Said fixing portion 421 is provided on said second piece 211 in the proximity of said elastic jointing-portion 311 and close to the main body of the second piece 211. In other words, the fixing portion 421 is provided below and in the proximity of said fulcrum portion 32 to prevent the contact portion 22 and the elastic jointing-portion 31 (including the fulcrum portion 32 and the elastic portion 34) of the second contact 15 from being raised (warped). As shown in FIGS. 7B and 8B, the fixing portion 421 forms with the main body of the second piece 211 a U-shaped portion to embrace the part of the housing 12, whereby the locking member 17 is fixed. The positions and size of said fixing portions 421 may be suitably designed taking into account such functions, holding forces and the like.

The engaging portion 56 of said locking member 17 is of a protruded shape for facilitating the engagement with the anchoring portion 82 of the connecting object such as the flexible printed circuit board or flexible flat cable. Said connection portion 241 is of a surface mounting type (SMT) in the illustrated embodiment, but it may be a dip type. The shape and size of said engaging portion 56 may be suitably designed so as to permit a flat portion of said engaging portion 56 to engage said anchoring portion 82 upon the engagement of the engaging portion 56 of said locking member 17 and the anchoring portion 82 of said flexible printed circuit board, and in consideration of the strength of said locking member 17.

As is the case with said second contact 14, after the connecting object such as the flexible printed circuit board 80 or flat cable has been inserted into the fitting opening 18 of the housing 12, when the pushing portions 36 of said pivoting member 16 are pivotally moved between the pressure receiving portions 201 and the connection portions 241 of said locking members 17, said pressure receiving portions 201 are raised by said pushing portions 36 so that the elastic portions 341 of said locking members 17 are tilted toward said engaging portions 56 about the fulcrum portions 321 of said locking members 17, thereby causing said engaging portions 56 to engage the anchoring portions 82 of the connecting object such as the flexible printed circuit board 80 or flexible flat cable. The sizes and shapes of said fulcrum portions 321, said elastic portions 341, and said pressure receiving portions 201 may be suitably designed so as to achieve such functions.

The pivoting member 16 will then be explained. The pivoting member 16 is formed from an electrically insulating plastic material by means of the injection molding of the known technique. The materials for the pivoting member 16 may be suitably selected taking into account dimensional stability, workability, manufacturing cost, and the like and generally include polybutylene terephthalate (PBT), polyamid (66PA or 46PA), liquid crystal polymer (LCP), polycarbonate (PC) and the like and combination thereof. Said pivoting member 16 mainly comprises an actuating portion 37, axles 28 adapted to be fitted in the housing 12 for pivotal movements, the pushing portions 36 for pushing the pressure receiving portions 20 of said contacts, and the anchoring holes 30 adapted to engage the extended portions 26 of said contacts. Said axles 28 are a fulcrum for pivotally moving the pivoting member 16 and are suitably fitted in both the longitudinal ends of the housing 12 to enable the pivotal movement of the pivoting member 16. Moreover, the pivoting member 16 is provided at both longitudinal ends with locking portions adapted to engage the housing 12 so as to prevent the pivoting member 16 from being raised (upwardly viewed in the drawing) when the pressure receiving portions 20 of said contacts are pushed by the pushing portions of the pivoting member. The shape and size of the locking portions may be any ones insofar as they can engage the housing and suitably designed in consideration of the function described above, the size, strength and the like of the connector 10.

Said pushing portions 36 are for pushing the pressure receiving portions 20 of said contacts. The pushing portions 36 are preferably of an elongated shape in cross-section, and elliptical in the illustrated embodiment. With such an elliptical shape, when the pivoting member is pivotally moved in the direction shown by an arrow "A" as shown in FIG. 1A so as to pivotally move its pushing portions 36 between the pressure receiving portions 20 and the connection portions 24 of said second contacts 15, the pressure receiving portions 20 of said second contacts 15 are moved upwardly with the aid of the variation in contact height of the pushing portions 36 owing to, for example, difference in major and minor axes of an ellipse so that the contact portions 22 of said second contacts 15 are forced against the connecting object such as the flexible printed circuit board or flexible flat cable. The shape of the pushing portions 36 may be of any one so long as the pushing portions 36 can be pivotally moved between the pressure receiving portions 20 and the connection portions 24 of said second contacts 15, and the pressure receiving portions 20 of said second contacts 15 can be raised with the aid of the variation in contact height such as difference in major and minor axes of the elliptical cross-section of the pushing portions 36.

In order to prevent the center of the pivoting member 16 from being deformed in the direction shown by the arrow "B" in FIG. 1A owing to the strong reaction forces against the pivotal movement of the pivoting member 16 when it is pivotally moving, the pivoting member 16 is provided with the anchoring holes 30 independently from one another which are adapted to be engaged with the extended portions 26 of said second contacts 15. The anchoring holes 30 provided independently from one another will contribute to enhancing the strength of the pivoting member 16 and prevent the deformation of the pivoting member when it is pivotally moving.

Finally, the housing 12 will be explained. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and combination thereof.

Said housing 12 is formed with the inserting holes 38 into which a required number of contacts are installed by press-fitting, hooking (lancing), welding or the like.

The housing 12 is provided at both the longitudinal ends with bearings in which the axles of said pivoting member 16 are fitted to be pivotally moved. The shape and size of the bearings may be any ones so long as the axles of the pivoting member 16 are pivotally moved and said pushing portions 36 can be moved and pivotally moved as described below and may be suitably designed taking into account the functions, and the strength, size and the like of the housing 12. Moreover, the housing 12 is provided at both the longitudinal ends with anchoring portions at locations corresponding to the locking portions of said pivoting member 16.

The housing 12 has a ceiling portion 23 for covering or insulating the contact portions 22 of the first pieces 19 of said second contacts 15, and the ceiling portion 23 is formed with protection walls 55 at least on both the ends for preventing the ceiling portion 23 from deforming upwardly when the connecting object is forced upwardly inadvertently. The term "protection wall" means the wall portion of an edge shape without being chamfered or inclined. In the illustrated embodiment, the protection walls 55 are provide only on both the ends on the ceiling potion of the fitting opening 18 of the housing 12. By providing the protection walls 55, however, the function and effect of guiding the connecting object such as the flexible printed circuit board 80 into the fitting opening 18 of the housing may be lost.

As a method for guiding the connecting object such as the flexible printed circuit board 80 into said fitting opening 18, the tip end of said flexible printed circuit board 80 is conducted into the fitting opening 18 in a manner putting or applying it onto the lower face of the fitting opening 18 of said-housing 12 shown in FIG. 1A (upper surfaces of the connection portions 24 of said first contacts 14), thereby easily guiding it into the fitting opening 18.

The inventors of the present application have ascertained the effects of said protection walls 55. Under a condition of the connector 10 with a flexible printed circuit board 80 inserted, the flexible printed circuit board 80 was pulled in a direction perpendicular to the connector in a tension testing machine (this condition corresponding to the condition that the printed circuit board is accidentally forced upwardly when the connector is used in its horizontal position). The results are shown in Table 1 below and a graph shown in FIG. 11. The "holding force" used herein is intended to mean the force at a moment when the contacts are disconnected from the flexible printed circuit board, while said flexible printed circuit board is being pulled in the vertical direction. The "prior art" connector used herein is the connector having the fitting opening of which ceiling portion is chamfered all over it without any protection wall 55. The "improved" connector 1 is the connector having the fitting opening of which ceiling portion is provided with protection walls only at both the ends (both the ends are not chamfered). The "improved" connector 2 is the connector having the fitting opening of which ceiling portion is provided with a protection wall 55 all over it.

TABLE 1

| | | Number of conductors | | | | | | | |
|---|---|---|---|---|---|---|---|---|---|
| | | 18 | | | | 27 | | | |
| | | Sample No. | | | | | | | |
| | | 1 | 2 | 3 | 4 | 1 | 2 | 3 | 4 |
| | Prior art | 3.6 N | 3.6 N | 4.1 N | 4.0 N | 4.2 N | 4.8 N | 4.6 N | 4.5 N |
| Improved connector with protection wall | Improved connector 2 (All over ceiling) | 9.1 N | 9.1 N | 8.8 N | 8.9 N | 9.1 N | 9.0 N | 9.0 N | 8.9 N |
| | Improved connector 1 (Only at both ends) | 8.6 N | 8.2 N | 8.4 N | 8.5 N | 9.2 N | 8.8 N | 8.6 N | 9.1 N |
| Mean value of Prior Art | | 3.83 N | | | | 4.53 N | | | |
| Mean value of improved connector | Improved connector 2 (All over ceiling) | 8.98 N | | | | 9.00 N | | | |
| | Improved connector 1 (Only at both ends) | 8.43 N | | | | 8.93 N | | | |

Figure 11:
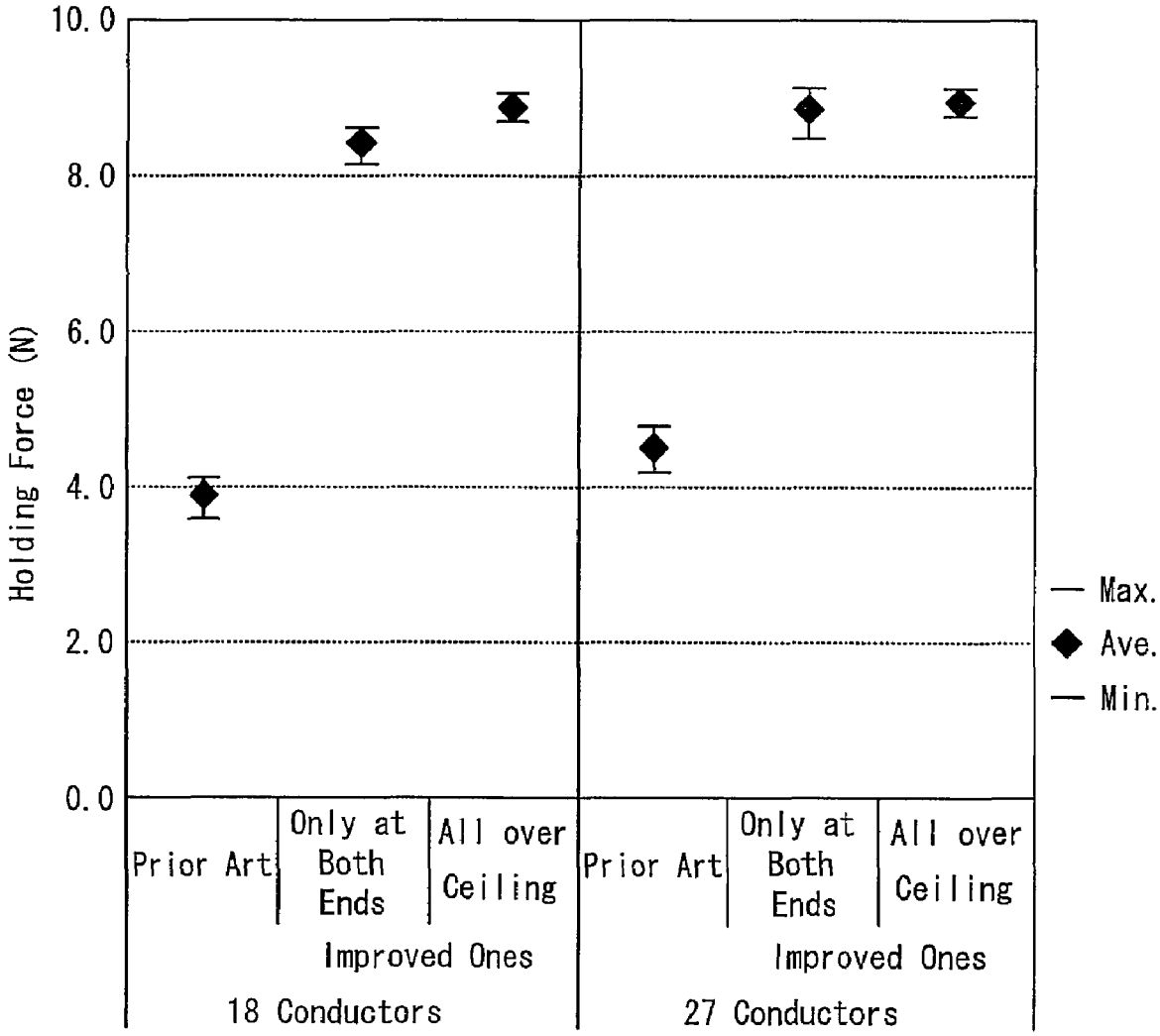
FIG. 11 is a graph illustrating how the holding force is increased by providing the protection walls according to the invention.

Referring to the Table 1 and the graph of FIG. 11, with respect to the average or mean values, the holding forces (forces at disconnection of the contacts) of the improved connectors 1 (protection walls only at ends) and 2 (protection wall all over the ceiling portion) with 18 conductors increase to 8.4 N and 8.9 N, respectively, while the holding forces with 27 conductors increase to 8.9 N and 9.0 N, respectively. Accordingly, with the improved connectors, the holding forces are approximately twice those of the prior art connectors. As can be seen from these results, the holding forces (forces at disconnection of contacts) are remarkably increased by providing the protection wall all over or at both the ends of the inserting opening. In other words, by providing the protection walls all over or at both the ends of inserting opening, the holding forces signifying the contact stability between the contacts and the connecting object will increase to twice when being subjected to accidental external forces. This means increased stability for accidental external forces. It is also apparent that there is no large difference in holding forces (forces at disconnection of contacts) between the protection walls provided only at both the ends and all over the ceiling portion of the inserting opening. The improved percentages of holding forces are 220.3% with 18 conductors and 197.2% with 27 conductors. The improved percentage is the value obtained by dividing a holding force for an improved connector by a holding force for a prior art connector. The number of locations provided with the protection wall 55 is preferably as few as possible in consideration of the fact that there is no large difference in holding forces (forces at disconnection of contacts) between the protection walls 55 provided only at both the ends and provided all over the ceiling portion 23 of the inserting opening 18, and the prevention of the connecting object such as the flexible printed circuit board 80 from being scratched (damaged). In the illustrated embodiment, the protection walls are provided only both the ends of the ceiling portion of the inserting opening, however, it is preferable to provide the protection walls at three locations, that is, at the center and both the ends in view of balancing. In order to prevent the connecting object such as the flexible printed circuit board from being scratched (damaged), it is preferable to design the housing so that it does not contact the connecting object when the connecting object is accidentally subjected to an external force. For this purpose, it is considered to provide a chamfered portion, round chamfer, recessed chamfer or stepped recess. The chamfered portion is preferable taking into account esthetical quality, material cost and the like. With respect to the conducting the connecting object into the fitting opening 18, by employing the method described above, it is possible to conduct it sufficiently without chamfering the ceiling portion of the fitting opening.

The movement and pivotal movement of the pushing portions 36 of said pivoting member 16 will then be explained with reference to FIGS. 9A to 9E in which the pushing portion 36 is pivotally moved between the pressure receiving portion 20 and the connection portion 24 of the second contact 15 by way of example.

Figure 9A:
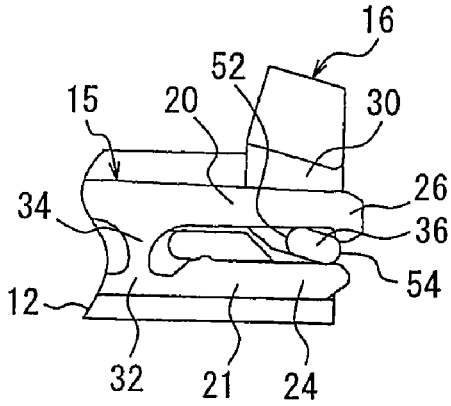
FIGS. 9A to 9E are explanatory view for explaining movements of a pushing portion and an axis of rotation when the pivoting member is being pivotally moved.

FIG. 9A illustrates the state that a connecting object is not inserted into the connector 10. The lower end 54 of said pushing portion 36 is positioned between the extended portion 26 of said pressure receiving portion 20 and the connection portion 24 of the contact 15.

Figure 9B:
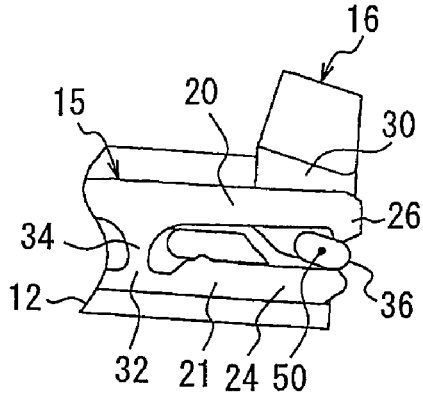

As shown in FIG. 9B, when said actuating portion 37 of the pivoting member 16 is pivotally moved (in the clockwise direction viewed in the drawing), the pushing portion 36 is moved in an opposite direction from the fitting opening 18 of the housing so that the lower end 54 of said pushing portion 36 is embraced between the extended portion 26 of said pressure receiving portion 20 and the connection portion 24.

Figure 9C:
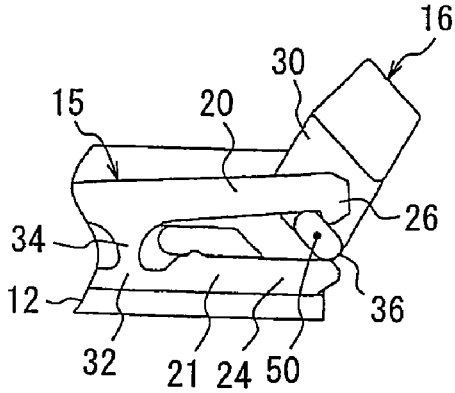
Figure 9D:
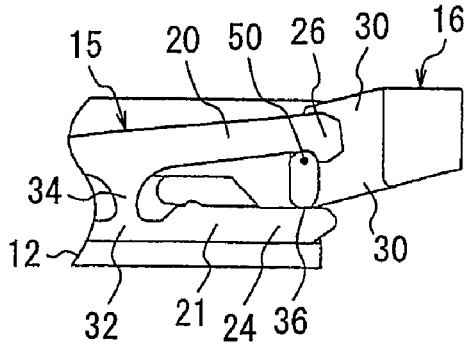

As shown in FIG. 9C, when the actuating portion 37 is further pivotally moved, said pushing portions 36 at its position shown in FIG. 9B is pivotally moved about the center of the pushing portion 36 as the rotational axis 50. As shown in FIG. 9D, when said actuating portion 37 is further pivotally moved, the pushing portion 36 at its position shown in FIG. 9C is pivotally moved about the center of the pushing portion 36 as the rotational axis 50 so that the pushing portion 36 stands substantially upright between said pressure receiving portion 20 and said connection portion 24 and the rotational axis 50 is moved toward the upper end 52 in contact with the extended portion 26.

Figure 9E:
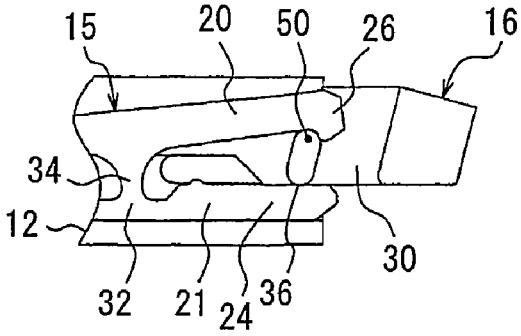
Figure 10A:
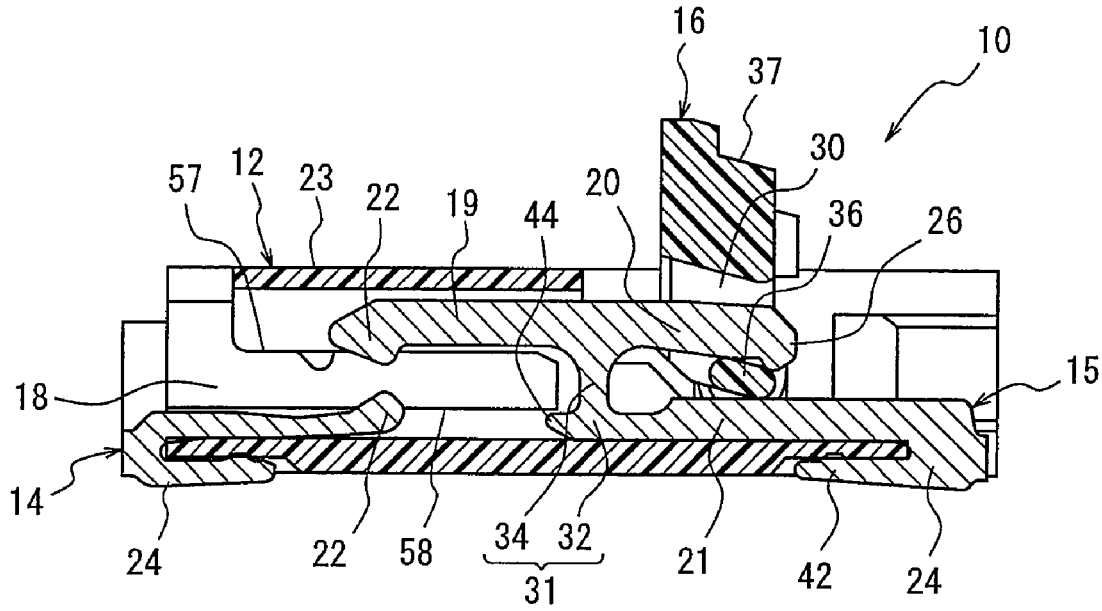
FIG. 10A PRIOR ART
FIG. 10A is a section view of the connector of the prior art with the pivoting member opened, taken along one inserting hole for contacts.
Figure 10B:
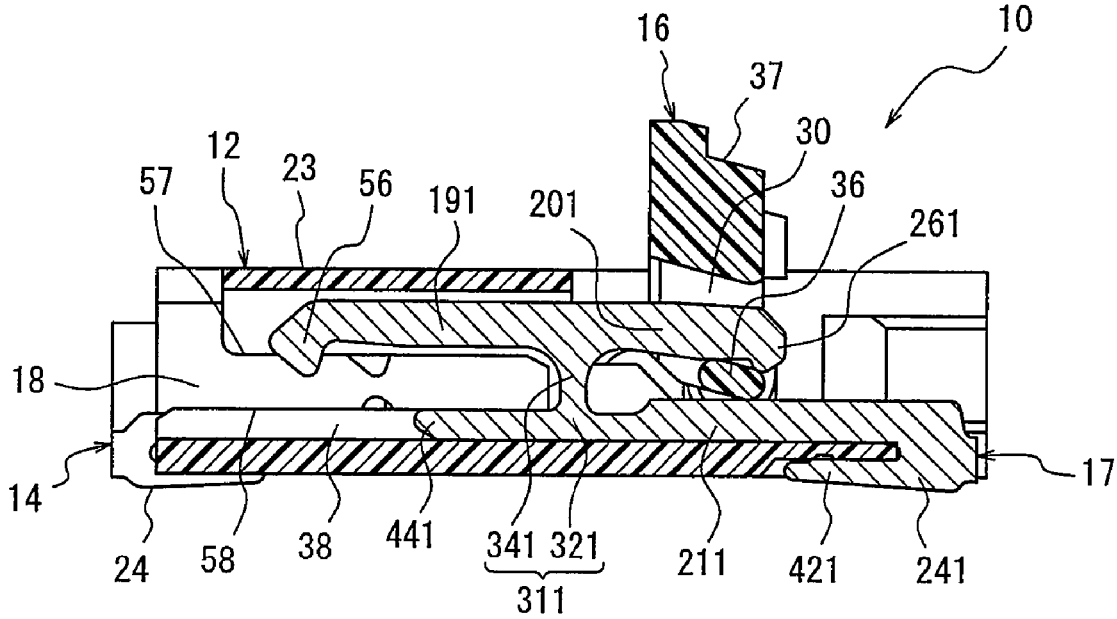
FIG. 10B PRIOR ART
FIG. 10B is a section view of the connector of the prior art with the pivoting member opened, taken along one inserting hole for a locking member.

As shown in FIG. 9E, when the actuating portion 37 is further pivotally moved, the pushing portion 36 at its position shown in FIG. 9D is pivotally moved about a center in the proximity of the upper end 52 in contact with the extended portion 26 so that the pushing portion 36 engages the extended portion 26 in a manner that the pushing portion 36 catches the extended portion 26.

In other words, the pushing portion 36 is initially moved and then pivotally moved, and when the pushing portion 36 is further pivotally moved, the rotational axis 50 progressively changes or moves so that the pushing portion 36 performs its compact and space-saving pivotal movement or rotation.

In the connector 10 according to the invention, namely, first, when a connecting object such as the flexible printed circuit board 80 is inserted into the fitting opening 18 of the housing, a force is not required because of the so-called "zero-insertion force" type. Then, the pushing portions 36 of the pivoting member 16 are pivotally moved at a location closer to the extended portions 26 of said contacts 15 (to push the pressure receiving portions 20 of said contacts upwardly at a location closer to the extended portions 26) so that the pivoting member 16 can be locked with a slight force. Moreover, the pressure receiving portions 20 of said contacts are pushed upwardly by the pushing portions 36 of said pivoting member 16 at the location closer to the extended portions 26 so that a greater contact force can be obtained between the contacts and the connecting object.

Now, the relations will be explained between the size of said fitting opening 18 (distance between the upper surface 57 and the lower surface 58 of the fitting opening), the thickness of the connecting object such as said flexible printed circuit board 80, and the contact portions 22 of the first and second contacts 14 and 15. Under the state that the connecting object such as the flexible printed circuit board has not been inserted into the fitting opening of the housing, the contact portions 22 of said second contacts 15 are in said inserting holes without extending beyond the upper surface 57 of the fitting opening into the fitting opening 18. The contact portions 22 of said first contacts 14 extend beyond the lower surface 58 of the fitting opening into the fitting opening 18 so that the distance between the tips of the contact portions 22 of said first contacts 14 and the upper surface 57 of the fitting opening becomes smaller than the thickness of said connecting object (FIGS. 7A and 7B). In other words, under the state that the connecting object such as the flexible printed circuit board has been inserted into the fitting opening of the housing, the connecting object is always in contact with the contact portions 22 of said first contacts 14 to construct a structure ensuring a minimal contacting force (FIGS. 8A and 8B). The same holds true in the case that the flexible printed circuit board 80 is accidentally subjected to an external force. Namely, in order to ensure the minimal contacting force even when the connecting object such as the flexible printed circuit board 80 is accidentally subjected to an external force, suitably designed are the relations between the size of said fitting opening 18 (distance between the upper surface 57 and the lower surface 58 of the fitting opening), the thickness of the connecting object such as said flexible printed circuit board 80, and the contact portions 22 of the first and second contacts 14 and 15.

Examples of applications of the invention are connectors for use in mobile or cellular phones, notebook personal computers, digital cameras and the like, and more particularly to connectors superior in stable electrical connection without contacts being warped or deformed when the pivoting member is being pivotally moved after a connecting object (flexible printed circuit board or flexible flat cable) has been inserted, and ensuring sufficient holding forces for the connecting object, and achieving a reduced overall height of the connector and a high density of conductors.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector including a required number of contacts each having a contact portion adapted to contact a flexible board, and a connection portion to be connected to a substrate, a housing having inserting holes for arranging and holding said contacts inserted in said inserting holes and a fitting opening into which said flexible board is inserted, and a pivoting member mounted on said housing on the opposite side of said fitting opening and causing said contacts to be elastically deformed so as to push said contacts against said flexible board, wherein said contacts consist of two kinds of first contacts and second contacts, and a first contact and a second contact are arranged in one and the same inserting hole of said housing so that the contact portions of the first and second contacts are facing each other, wherein said first contacts each comprise the contact portion at one end and the connection portion at the other end, and said second contacts each comprise a first piece having the contact portion at one end and a pressure receiving portion at the other end, a second piece having the connection portion at an outer end, and an inclined elastic jointing-portion for joining said first piece and the remaining end of said second piece, wherein said pivoting member comprises an actuating portion for pivotally moving said pivoting member, pushing portions provided continuously in the longitudinal direction of the pivoting member, and anchoring holes independent from one another for receiving therein said pressure receiving portions, respectively, and said pushing portions are pivotally movable between said pressure receiving portions and said connection portions of said contacts, during which pivotal movement, the axis of rotation of said pushing portions is moved with their pivotal movement to achieve their compact rotation, wherein said second contacts are each provided on said second piece with a fixing portion located substantially at the same location as said elastic jointing-portion, thereby preventing said second contacts from being warped when said pivoting member is being pivotally moved, wherein said fixed portion extends outwardly from said second piece and spaced from said elastic jointing portion, and said fixed portion gripping a bottom edge of the housing;

wherein said flexible board is provided with anchoring portions on both sides in its width direction, and locking members each having engaging portion adapted to engage said anchoring portion are installed in said housing, and wherein said locking members each comprise a first piece having said engaging portion at one end and a pressure receiving portion at the other end, a second piece having a connection portion at an outer end, and an inclined elastic jointing-portion for joining said first piece and the remaining end of said second piece, and each of said locking members are further provided on said second piece with a fixing portion located substantially at the same location as said elastic jointing-portion; and wherein said fixed portion of each of said locking members extends outwardly from said second piece of said each of said locking members and spaced from said elastic jointing portion of said each of said locking members, and said fixed portion of said each of said locking members gripping the bottom edge of the housing.

2. The connector as claimed in claim 1, wherein under a state that said flexible board is not inserted into said fitting opening of said housing, the contact portions of said second contacts are in said inserting holes without extending beyond the upper surface of said fitting opening into said fitting opening, and the contact portions of said first contacts extend beyond the lower surface of said fitting opening into said fitting opening so that the distance between tips of the contact portions of said first contacts and the upper surface of said fitting opening is smaller than the thickness of said flexible board, and wherein under a state that said flexible board has been inserted into said fitting opening of said housing and said pivoting member has been pivotally moved, said flexible board remains in contact with the contact portions of said first contacts without said flexible board being raised upwardly beyond the upper surface of the fitting opening of said housing even when said flexible board is accidentally subjected to an external force.

* * * * *